US008002574B1

(12) United States Patent
Yi

(10) Patent No.: US 8,002,574 B1
(45) Date of Patent: Aug. 23, 2011

(54) RF MODULE WITH A HOUSING WITH SPRING LOADED CONNECTORS AND A STRAIN RELIEF EXTENDING REARWARD OF THE HOUSING

(75) Inventor: Chong Hun Yi, Mechanicsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/939,862

(22) Filed: Nov. 4, 2010

(51) Int. Cl.
*H01R 13/58* (2006.01)

(52) U.S. Cl. ..... 439/455

(58) Field of Classification Search ..... 439/449–473, 439/578–585
See application file for complete search history.

(56) References Cited

U.S. PATENT DOCUMENTS

| | | | | |
|---|---|---|---|---|
| 5,775,957 | A * | 7/1998 | Fink et al. | 439/752 |
| 5,954,546 | A * | 9/1999 | Fink et al. | 439/752 |
| 6,428,344 | B1 * | 8/2002 | Reed | 439/455 |
| 6,585,528 | B1 * | 7/2003 | Lin et al. | 439/76.1 |
| 6,648,674 | B1 * | 11/2003 | Dobler | 439/460 |
| 6,878,008 | B2 * | 4/2005 | Brancaleone | 439/457 |
| 7,641,500 | B2 * | 1/2010 | Stoner et al. | 439/357 |
| 7,758,374 | B2 * | 7/2010 | Yu et al. | 439/493 |

* cited by examiner

*Primary Examiner* — Chandrika Prasad

(57) ABSTRACT

An RF module includes a housing that has walls defining connector cavities. The walls include a rear wall that has a plurality of openings therethrough. The connector cavity is open opposite the rear wall to receive an electrical connector. RF connectors are received in the connector cavities. The RF connectors are terminated to corresponding cables. The RF connectors extend through the corresponding opening and are spring loaded in the connector cavity to allow the RF connectors to float in the connector cavity. A strain relief feature extends from the housing rearward of the rear wall and has a plurality of pockets configured to receive corresponding cables extending from the RF connectors.

20 Claims, 7 Drawing Sheets

RF MODULE WITH A HOUSING WITH SPRING LOADED CONNECTORS AND A STRAIN RELIEF EXTENDING REARWARD OF THE HOUSING

BACKGROUND OF THE INVENTION

The subject matter herein relates generally to electrical connector assemblies, and more particularly to RF modules.

Due to their favorable electrical characteristics, coaxial cables and connectors have grown in popularity for interconnecting electronic devices and peripheral systems. Typically, one connector is mounted to a circuit board of an electronic device at an input/output port of the device and extends through an exterior housing of the device for connection with a coaxial cable connector. The connectors include an inner conductor coaxially disposed within an outer conductor, with a dielectric material separating the inner and outer conductors.

A typical application utilizing coaxial cable connectors is a radio-frequency (RF) application having RF connectors designed to work at radio frequencies in the UHF and/or VHF range. RF connectors are typically used with coaxial cables and are designed to maintain the shielding that the coaxial design offers. RF connectors are typically designed to minimize the change in transmission line impedance at the connection by utilizing contacts that have a short contact length. The connectors have a short mating distance and, particularly when using multiple connectors in a single insert, typically include a pre-compressed spring to ensure the connectors are pushed forward and the contacts are engaged.

Known RF connectors having springs are not without disadvantages. For instance, known connectors allow compression along the axial direction of the connector, thus forcing the contact toward the mating contact. However, during mating, the contact axes of the connectors may not be properly aligned with one another. The spring thus forces the contact in an undesired direction and may cause damage to the contacts. Additionally, when the coaxial cables are routed to other components behind the connectors, the cables tend to pull the RF connectors in different directions, causing the mating ends of the RF connectors to be tilted or rotated within the housing. If tilted enough, the RF connector may not be able to properly mate with the mating connector and/or damage may be caused to the contacts.

A need remains for a connector assembly that may be manufactured in a cost effective and reliable manner. A need remains for a connector assembly that may be mated in a safe and reliable manner.

BRIEF DESCRIPTION OF THE INVENTION

In one embodiment, an RF module is provided with a housing that has walls defining connector cavities. The walls include a rear wall that has a plurality of openings therethrough. The connector cavity is open opposite the rear wall to receive an electrical connector. RF connectors are received in the connector cavities. The RF connectors are terminated to corresponding cables. The RF connectors extend through the corresponding opening and are spring loaded in the connector cavity to allow the RF connectors to float in the connector cavity. A strain relief feature extends from the housing rearward of the rear wall and has a plurality of pockets configured to receive corresponding cables extending from the RF connectors.

In another embodiment, an RF module is provided including a housing that has walls defining connector cavities. The walls include a rear wall that has a plurality of openings therethrough. The openings are configured to receive corresponding RF connectors therein with portions of the RF connectors received in the connector cavity and portions of the RF connectors positioned rearward of the rear wall. The connector cavity is open opposite the rear wall to receive an electrical connector assembly configured to mate with the RF connectors held by the housing. A strain relief feature extends from the housing rearward of the rear wall and has a plurality of pockets configured to receive cables extending from corresponding RF connectors.

In a further embodiment, an electrical connector system is provided having an RF module including a housing that has walls that define connector cavities. The walls include a rear wall that has a plurality of openings therethrough. The connector cavity is open opposite the rear wall to receive an electrical connector. RF connectors are received in the connector cavity and are terminated to corresponding cables. The RF connectors extend through corresponding openings and are spring loaded in the connector cavity to allow the RF connectors to float in the connector cavity. A strain relief feature extends from the housing rearward of the rear wall and has a plurality of pockets configured to receive corresponding cables extending from the RF connectors. The electrical connector system also includes a electrical connector assembly that has a housing holding a plurality of electrical connectors. Each electrical connector has a shell holding a center contact. The electrical connector assembly is coupled to the RF module such that the electrical connectors are mated with corresponding RF connectors.

DETAILED DESCRIPTION OF THE INVENTION

Figure 1:
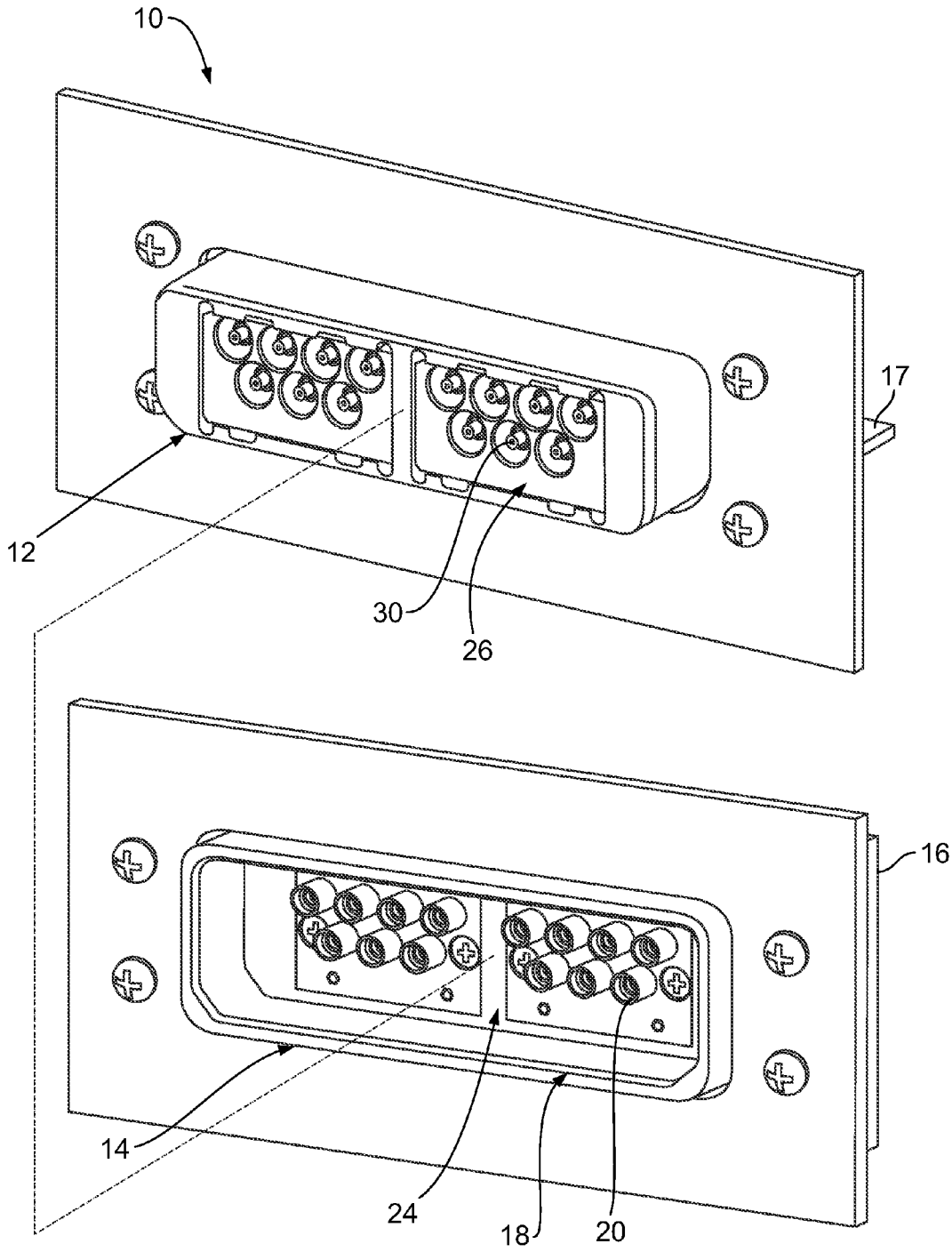
FIG. 1 illustrates an electrical connector system formed in accordance with an exemplary embodiment including an RF module and an electrical connector assembly.

FIG. 1 illustrates an electrical connector system 10 including an RF module 12 and an electrical connector assembly 14 formed in accordance with an exemplary embodiment. FIG. 1 shows front perspective views of both the RF module 12 and the electrical connector assembly 14, which are configured to be mated together along the phantom line shown in FIG. 1. In an exemplary embodiment, the electrical connector assembly 14 defines a motherboard assembly that is associated with a motherboard 16. The RF module 12 defines a daughtercard assembly that is associated with a daughtercard 17.

The electrical connector assembly 14 includes a housing 18 and a plurality of electrical connectors 20 held within the housing 18. Any number of electrical connectors 20 may be utilized depending on the particular application. In the illustrated embodiment, seven electrical connectors 20 are provided in two rows. The electrical connectors 20 are cable mounted to respective coaxial cables 22 (shown in FIG. 4). Alternatively, the electrical connectors 20 may be terminated to the motherboard 16. The housing 18 includes a mating cavity 24 that defines a receptacle for receiving the RF module 12.

In an exemplary embodiment, the RF module 12 defines a plug that may be received within the mating cavity 24. The RF module 12 includes a housing 26 and a plurality of RF connectors 30 held within the housing 26. The RF connectors 30 are cable mounted to respective coaxial cables 32 (shown in FIG. 4). The RF module 12 and electrical connector assembly 14 are mated with one another such that the electrical connectors 20 mate with the RF connectors 30. In alternative embodiments, the RF module 12 and electrical connector assembly 14 are both board mounted, or alternatively, one of the RF module 12 and electrical connector assembly 14 are cable mounted, while the other is board mounted.

Figure 2:
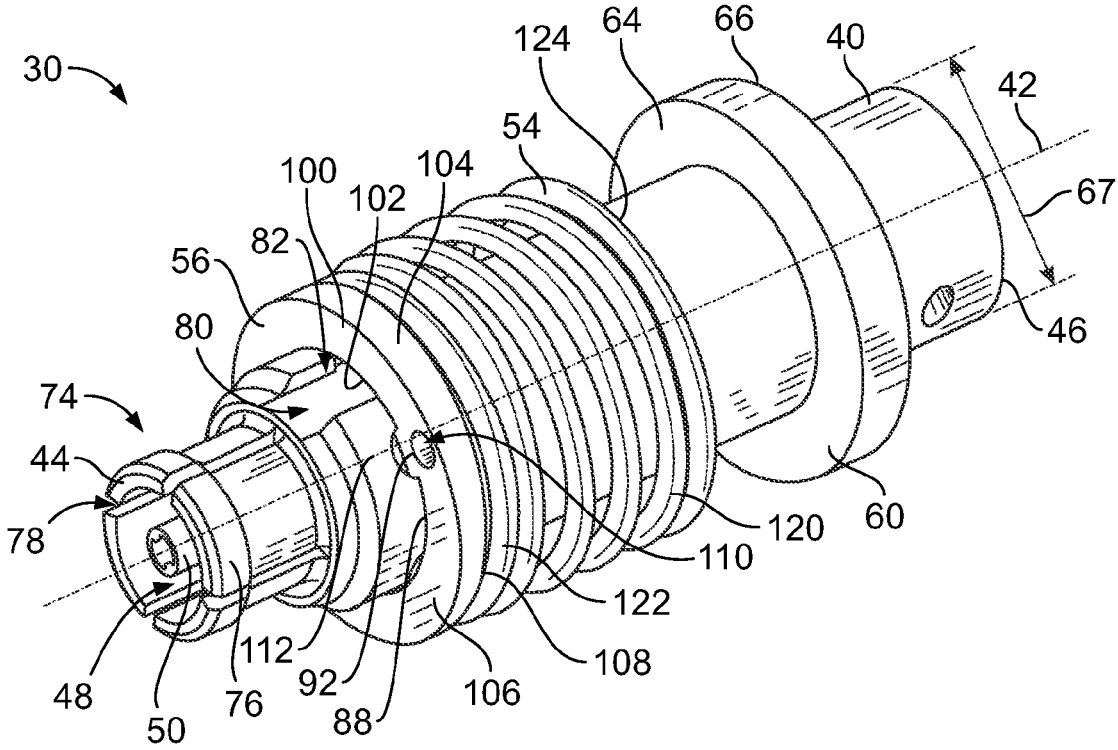
FIG. 2 is a perspective view of an RF connector for use with the system shown in FIG. 1.

FIG. 2 is a perspective view of one of the RF connectors 30. The RF connector 30 includes a shell 40 extending along a central longitudinal axis 42 between a mating end 44 and a cable end 46. The shell 40 defines a shell cavity 48. The RF connector 30 includes a center contact 50 held within the shell cavity 48. In an exemplary embodiment, a dielectric body 52 (shown in FIG. 3) is positioned between the shell 40 and the contact 50. In an exemplary embodiment, the shell 40 is formed from a conductive material, such as a metal material, and the dielectric body 52 electrically separates the contact 50 and the shell 40. The RF connector 30 includes a spring 54 concentrically surrounding a portion of the shell 40. The RF connector 30 includes a retaining washer 56 used to retain the spring 54 in position with respect to the shell 40.

The shell 40 is cylindrical in shape. A flange 60 extends radially outward from the shell 40. The flange 60 is positioned proximate the cable end 46. In the illustrated embodiment, the flange 60 is positioned a distance from the mating end 44. The flange 60 includes a forward facing surface 64 and a rear facing surface 66. The surfaces 64, 66 are generally perpendicular with respect to the longitudinal axis 42.

The shell 40 is tapered or stepped at the mating end 44 such that a shell diameter 67 at the mating end 44 is smaller than along other portions of the shell 40. The shell 40 includes a tip portion 74 forward of the third shoulder 72. When the RF connector 30 is mated with the electrical connector 20 (shown in FIG. 1), the tip portion 74 is received within the electrical connector 20. In an exemplary embodiment, the tip portion 74 includes a plurality of segments 76 that are separated by gaps 78. The segments 76 are movable with respect to one another such that the segments 76 may be deflected toward one another to reduce the diameter of the tip portion 74 for mating with the electrical connector 20. Deflection of the segments 76 may cause a friction fit with the electrical connector 20 when mated.

The washer 56 includes a ring-shaped body 100 having a radially inner surface 102 and a radially outer surface 104. The washer 56 includes a forward facing surface 106 and a rear engagement surface 108.

The spring 54 has a helically wound body 120 extending between a front end 122 and a rear end 124. The rear end 124 faces the forward facing surface 64 of the flange 60. The spring 54 is loaded over the mating end 44 and concentrically surrounds a portion of the shell 40. The spring 54 has a spring diameter that is greater than the shell diameter 67. The spring 54 is compressible axially.

During assembly, the retaining washer 56 is loaded onto the mating end 44 of the shell 40 and holds the spring 54 in position relative to the shell 40. The rear engagement surface 108 of the washer 56 engages the front end 122 of the spring 54. Optionally, the washer 56 may at least partially compress the spring 54 such that the spring is biased against the washer 56.

Figure 3:
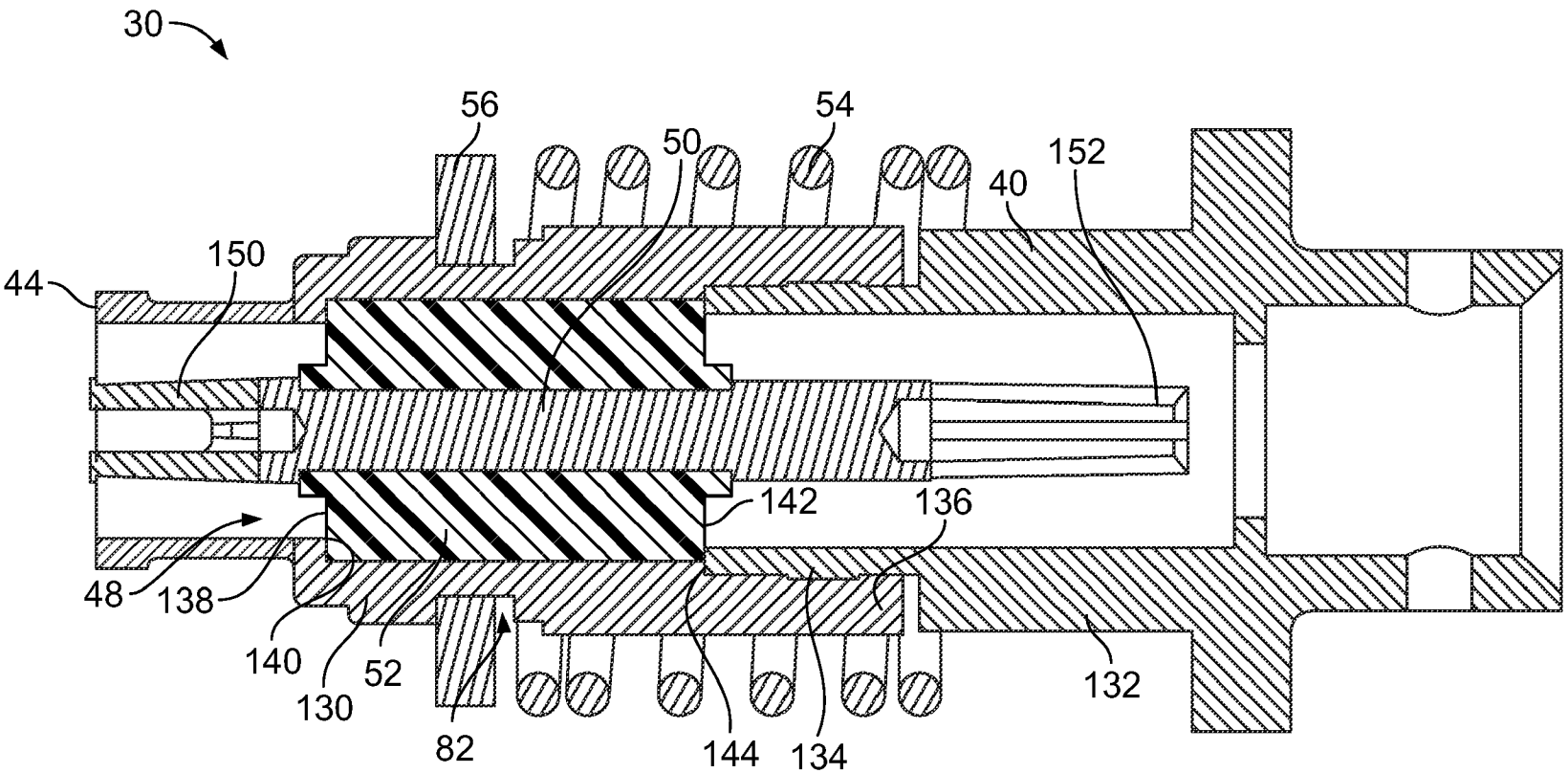
FIG. 3 is a cross-sectional view of the RF connector shown in FIG. 2.

FIG. 3 is a cross-sectional view of the RF connector 30. In the illustrated embodiment, the shell 40 includes a front shell 130 and a rear shell 132. A nose 134 of the rear shell 132 is received in a hood 136 of the front shell 130. The dielectric body 52 is held within the shell cavity 48. For example, a front end 138 of the dielectric body 52 engages a lip 140 of the front shell 130 proximate to the mating end 44. A rear end 142 of the dielectric body 52 engages a front surface 144 of the rear shell 132. The dielectric body 52 is captured in the front shell 130 by the rear shell 132.

The contact 50 is held within the shell cavity 48 by the dielectric body 52. The contact 50 includes a mating end 150 and a terminating end 152. The mating end 150 is configured to mate with a center contact 154 (shown in FIG. 4) of the electrical connector 20. The mating end 150 is positioned proximate to the mating end 44 of the shell 40. The terminating end 152 is configured to be terminated to a cable, such as, to a center conductor (not shown) of a coaxial cable. The rear shell 132 is configured to mechanically and/or electrically connected to the cable, such as, to the cable braid, the cable insulator and/or the cable jacket.

Figure 4:
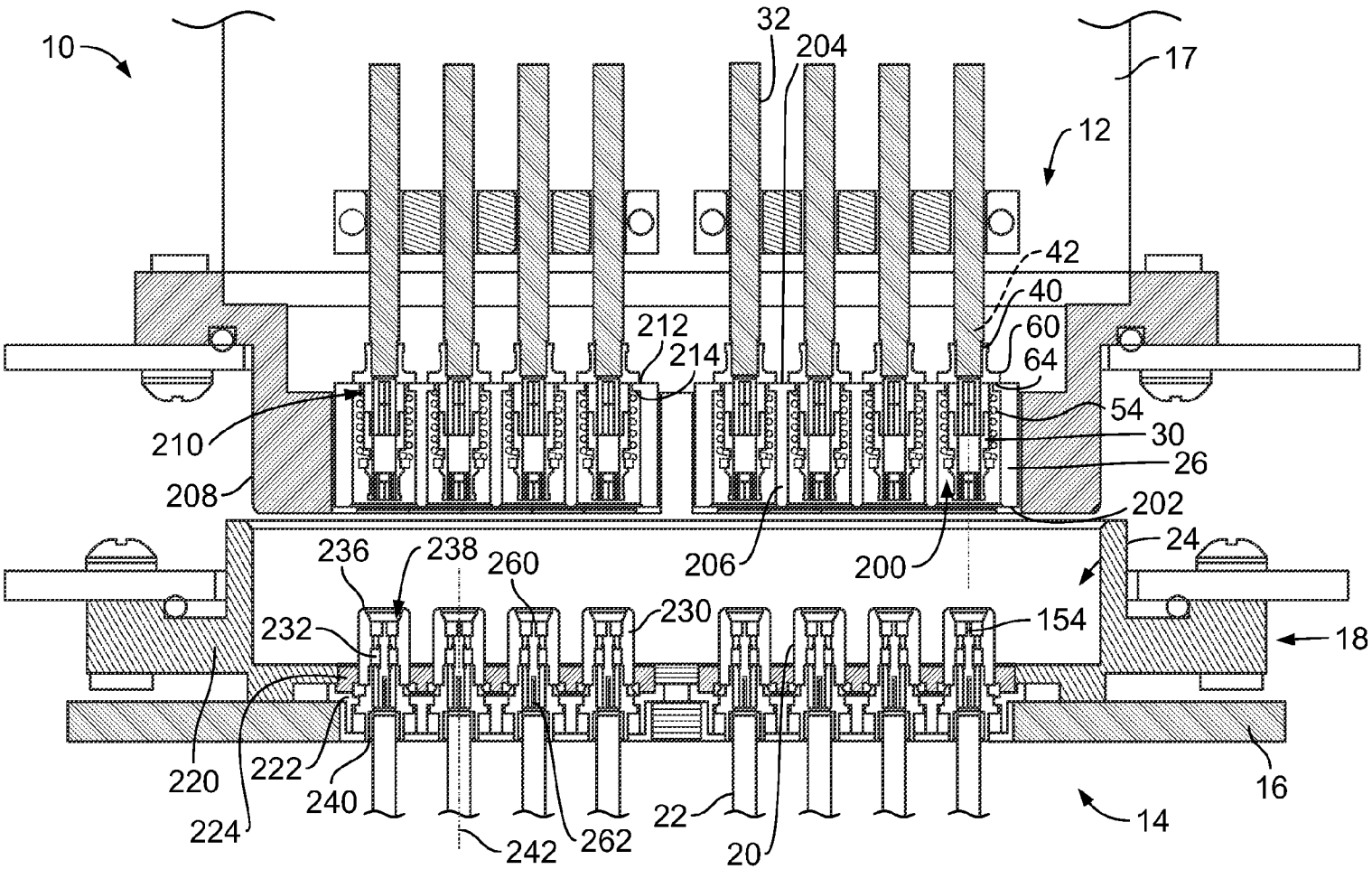
FIG. 4 is a partial cross-sectional view of the system shown in FIG. 1 illustrating the RF module and the electrical connector assembly poised for mating.

FIG. 4 is a partial cross sectional view of the connector system 10 illustrating the RF module 12 and electrical connector assembly 14 in an unmated position. The RF module 12 includes the housing 26 and a plurality of the RF connectors 30. The housing 26 includes a plurality of walls defining connector cavities 200. The housing 26 extends between a mating end 202 and a rear wall 204 on a back side of the housing 26. Some of the walls define interior walls 206 that separate adjacent connector cavities. Optionally, the connector cavities 200 may be cylindrical in shape. In the illustrated embodiment, the housing 26 is received in a chassis 208 that is part of the daughtercard assembly. Optionally, a plurality of RF modules 12 may be coupled within the chassis 208. The RF modules 12 may be identical to one another, or alternatively, different types of RF modules or other types of modules may be held in the chassis 208.

The rear wall 204 includes a plurality of openings 210 therethrough that provide access to the connector cavities 200. The RF connectors 30 extend through the openings 210 into the connector cavities 200. In an exemplary embodiment, a portion of the shell 40 is positioned outside of the housing 26 (e.g. rearward or behind the rear wall 204), and a portion of the shell 40 is positioned inside the connector cavity 200. The rear wall 204 includes first and second sides 212, 214, with the first side 212 facing rearward and outside of the housing 26 and the second side 214 facing forward and into the connector cavity 200. In an exemplary embodiment, the RF connector 30 is received in the connector cavity 200 such that the forward facing surface 64 of the flange 60 faces and/or engages the first side 212 of the rear wall 204. The flange 60 defines a stop against the rear wall 204 that limits forward movement of the RF connector 30 relative to the housing 26. The spring 54 engages the second side 214 of the rear wall 204. In an exemplary embodiment, the spring 54 is biased against the rear wall 204 to position the RF connector 30 relative to the rear wall 204. As such, the rear wall 204 is positioned between the spring 54 and the flange 60.

The electrical connector assembly 14 includes the housing 18 and a plurality of the electrical connectors 20. The housing 18 and electrical connectors 20 are mounted to the motherboard 16. The electrical connectors 20 extend through an opening in the motherboard 16 and are connected to the coaxial cables 22. The housing 18 includes a main housing 220 having walls defining the mating cavity 24. The main housing 220 is coupled to the motherboard 16, such as using fasteners (not shown).

The housing 18 includes an insert 222 and an organizer 224 separate from, and coupled to, the insert 222. The electrical connectors 20 are held by the insert 222 and organizer 224 as a subassembly, which is coupled to the main housing 220. For example, the subassembly is positioned in an opening on the main housing 220 and secured to the main housing 220 using fasteners (not shown). The electrical connectors 20 extend from the organizer 224 at least partially into the mating cavity 24.

Each electrical connector 20 includes a shell 230, a dielectric body 232 received in the shell 230 and one of the contacts 154 held by the dielectric body 232. The dielectric body 232 electrically isolates the contact 154 from the shell 230. The shell 230 includes a mating end 236 having an opening 238 that receives the RF connector 30 during mating. The shell 230 includes a terminating end 240 that is terminated to the coaxial cable 22. The electrical connector 20 extends along a longitudinal axis 242. During mating, the longitudinal axis 42 of each RF connector 30 is generally aligned with the longitudinal axis 242 of the corresponding electrical connector 20.

The contact 154 includes a mating end 260 and a mounting end 262 that is terminated to a center conductor of the coaxial cable 22. Alternatively, the mounting end 262 may be terminated to the motherboard 16 using press-fit pins, such as an eye-of-the-needle pin. The mounting end 262 is securely coupled to the insert 222. The mating end 260 is securely held by the organizer 224. The mating end 260 extends beyond the organizer 224 for mating with the RF connector 30.

Figure 5:
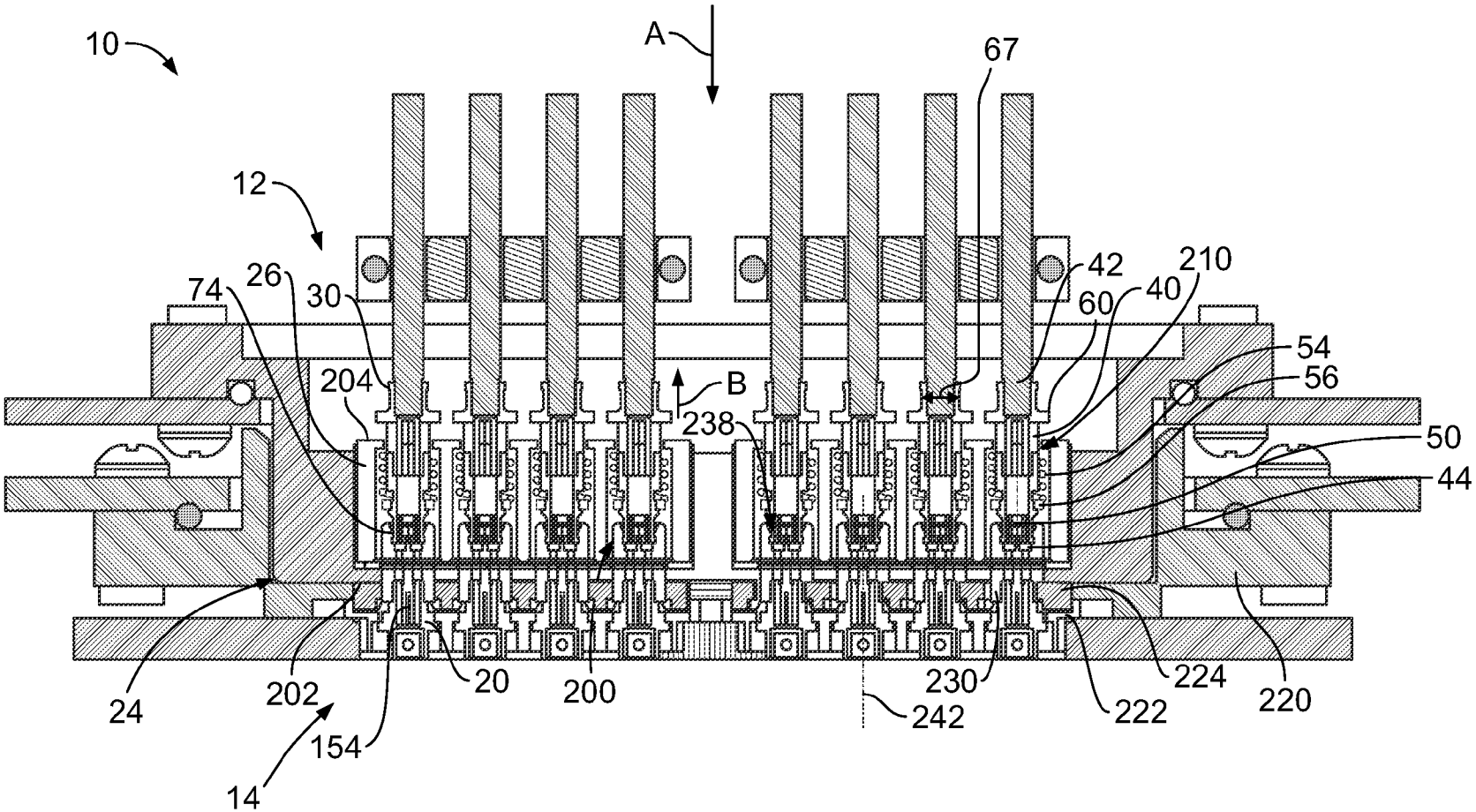
FIG. 5 is a partial cross sectional view of the connector system illustrating the RF module and electrical connector assembly in a mated position.

FIG. 5 is a partial cross sectional view of the connector system 10 illustrating the RF module 12 and electrical connector assembly 14 in a mated position. During mating, the RF module 12 is loaded into the mating cavity 24 in a loading direction, shown in FIG. 5 by an arrow A. Optionally, the RF module 12 is loaded into the mating cavity 24 until the mating end 202 of the housing 26 engages the main housing 220.

As the RF module 12 is mated with the electrical connector assembly 14, the RF connector 30 mates with the electrical connector 20. In the mated position, the tip portion 74 of the RF connector 30 is received in the opening 238 of the electrical connector 20. Optionally, the segments 76 (shown in FIG. 2) of the tip portion 74 may be flexed inward to fit within the opening 238. The tip portion 74 may be resiliently held within the opening 238. In the mated position, the contact 50 engages, and electrically connects to, the contact 154. In an exemplary embodiment, the shell 40 engages, and electrically connects to, the shell 230.

During mating, the spring 54 allows the RF connector 30 to float within the connector cavity 200 such that the RF connector 30 is capable of being repositioned with respect to the housing 26. Such floating or repositioning allows for proper mating of the RF connector 30 with the electrical connector 20. For example, the spring 54 may be compressed such that the relative position of the mating end 44 with respect to the rear wall 204 changes as the RF connector 30 is mated with the electrical connector 20. The organizer 224 holds the lateral position of the electrical connector 20 to keep the electrical connector 20 in position for mating with the RF connector 30. The organizer 224 resists tilting or rotating of the electrical connector 20 and keeps the electrical connector 20 extending along the longitudinal axis 242.

In an exemplary embodiment, the spring 54 may compress or flex to allow the RF connector 30 to reposition axially along the longitudinal axis 42 in a longitudinal direction, shown in FIG. 5 by the arrow B. A distance between the mating end 44 and the rear wall 204 may be shortened when the RF connector 30 is mated with the electrical connector 20. For example, when the tip portion 74 engages the electrical connector 20, the spring 54 may be compressed and the RF connector 30 may be recessed within the connector cavity 200. When the RF connector 30 is recessed within the connector cavity 200, the flange 60 is moved away from the rear wall 204. When the spring 54 is compressed, the spring 54 exerts a relatively higher biasing force against the washer 56 than when the spring 54 is not compressed, or when the spring 54 is less compressed. The biasing force is applied in a biasing direction, which may be generally along the longitudinal axis 42 toward the electrical connector 20. The spring 54 may maintain a reliable connection between the contact 50 and the mating contact 154 by forcing the RF connector 30 generally toward the electrical connector 20.

In addition to, or alternatively to, the axial repositioning of the RF connector 30, the RF connector 30 may be repositioned in a direction transverse to the longitudinal axis 42. For example, the RF connector 30 may be moved in a radial direction generally perpendicular with respect to the longitudinal axis 42. Optionally, the opening 210 in the rear wall 204 may have a larger diameter than the shell diameter 67 such that the shell 40 is movable within the opening in a non-axial direction (e.g. such as in a direction generally toward a portion of the opening 210). In an exemplary embodiment, in addition to, or alternatively to, the radial repositioning of the RF connector 30, the RF connector 30 may be repositioned by pivoting the RF connector 30 such that the longitudinal axis 42 is non-parallel to the central axis of the connector cavity 200. Such radial repositioning and/or pivoting may allow the RF connector 30 to align with the electrical connector 20 during mating. The organizer 224 rigidly holds the electrical connector 20 in position with respect to the main housing 220, generally parallel to the central axis of the connector cavities 200. The organizer 224 resists tilting and/or floating of the electrical connector 20.

In an exemplary embodiment, the RF connector 30 may float within the connector cavity 200 in at least two non-parallel directions. For example, the RF connector 30 may float in an axial direction, also known as a Z direction. The RF connector 30 may float in a first lateral direction and/or a second lateral direction, such as in directions commonly referred to as X and/or Y directions, which are perpendicular to the Z direction. The RF connector 30 may float in any combination of the X-Y-Z directions. The RF connector 30 may be pivoted, such that the mating end 44 is shifted in at least one of the lateral directions X and/or Y. The floating of the RF connector 30 may properly align the RF connector 30 with respect to the electrical connector 20. Optionally, the floating may be caused by engagement of the RF connector 30 with the electrical connector 20 during mating.

An exemplary embodiment of an RF module 12 is thus provided that may be manufactured in a cost effective and reliable manner. The RF module 12 may be mated with the electrical connector assembly 14 in a reliable manner. The RF connector 30 is movably received within the connector cavity 200 to properly mate with the electrical connector 20. In an exemplary embodiment, the RF connector 30 includes a spring 54 that allows the RF connector 30 to float within the connector cavity 200 in a plurality of directions or along a range of different movements. Assembly of the RF connector 30 is simplified by providing the spring 54 on the outside of the RF connector 30 and using the washer 56 to hold the spring 54 against the rear wall 204.

Figure 6:
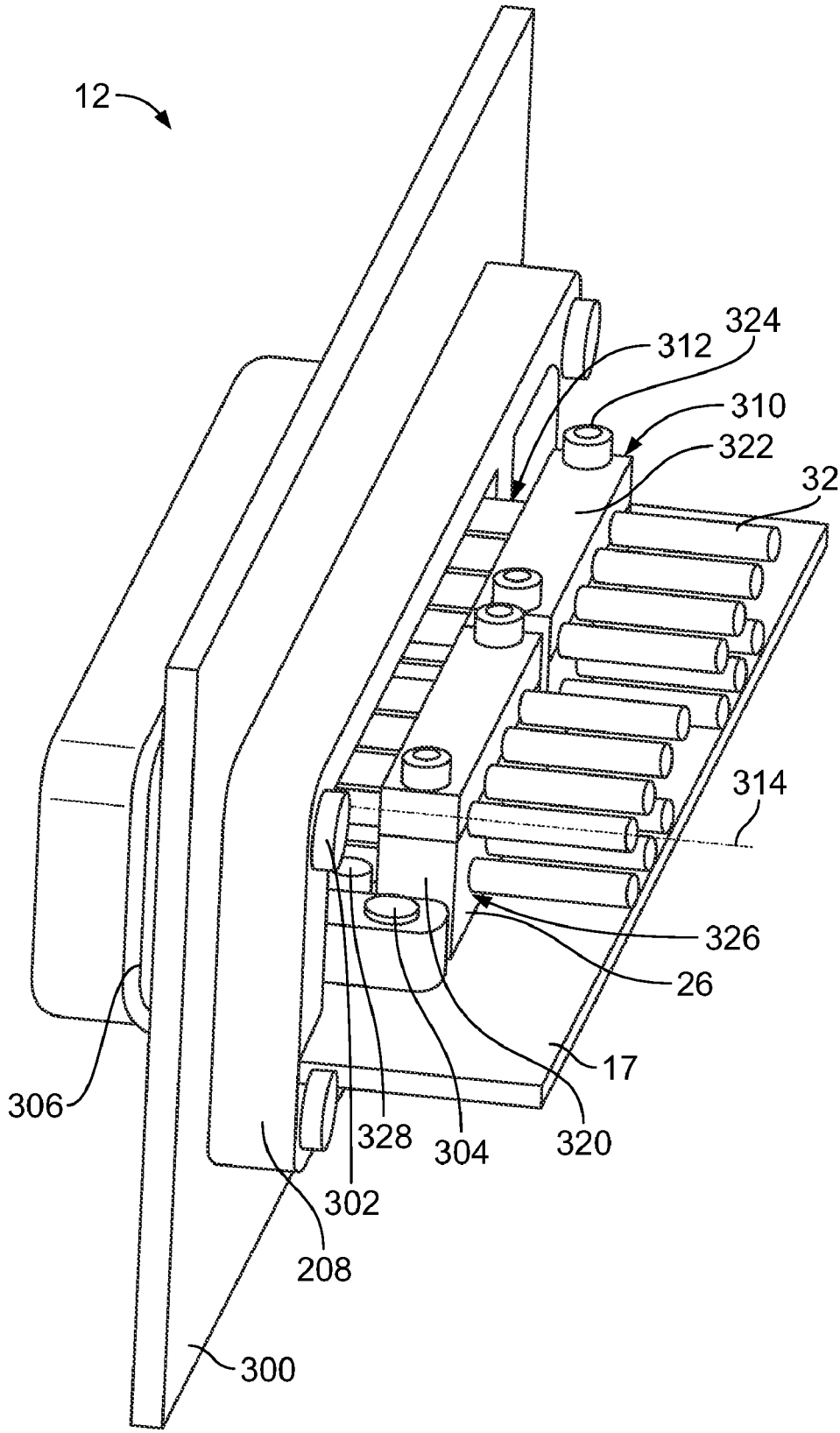
FIG. 6 is a rear perspective view of the RF module for use with the system shown in FIG. 1.

FIG. 6 is a rear perspective of the RF module 12. The RF module 12 is mounted to an insert 300 with a portion of the RF module 12 extending forward of the insert 300. The chassis 208 is secured to the insert 300 using fasteners 302. The chassis 208 is also mounted to the daughtercard 17 using fasteners 304. A gasket 306 is provided between the chassis 208 and the insert 300.

The housing 26 is loaded into the chassis 208. The housing 26 supports the RF connectors 30 (shown in FIG. 2). The housing 26 also supports the coaxial cables 32 extending from the RF connectors 30. In an exemplary embodiment, the RF module 12 includes a strain relief feature 310 that supports the cables 32. The strain relief feature 310 holds the cables 32 straight behind the RF connectors 30. The strain relief feature 310 ensures that the end portions 312 of the cables 32, which are the portions of the cables 32 between the strain relief feature 310 and the RF connectors 30, remain straight along longitudinal axis 314. The strain relief feature 310 provides strain relief for the connection between the RF connectors 30 and the coaxial cables 32. Portions of the coaxial cables 32 downstream of the strain relief feature 310 may be bent, routed or otherwise manipulated and pulled on in one or more directions, but the strain relief feature 310 ensures that the end portions 312 of the coaxial cables 32 extend along the longitudinal axis 314. As such, the RF connectors 30 are not rotated or tilted within the housing 26 by any lateral strain induced by the coaxial cables 32.

The strain relief feature 310 includes a base 320 and a cap 322. The cap 322 is coupled to the base 320 using fasteners 324. Other securing means may be used in alternative embodiments. The base 320 is positioned rearward of the rear wall 204 (shown in FIG. 4) of the housing 26. The base 320 includes pockets 326 that receive the coaxial cables 32. The cap 322 is secured to the base 320 to capture the coaxial cables 32 therebetween. In an exemplary embodiment, the strain relief feature 310 is coupled to the daughtercard 17 using fasteners 328.

Figure 7:
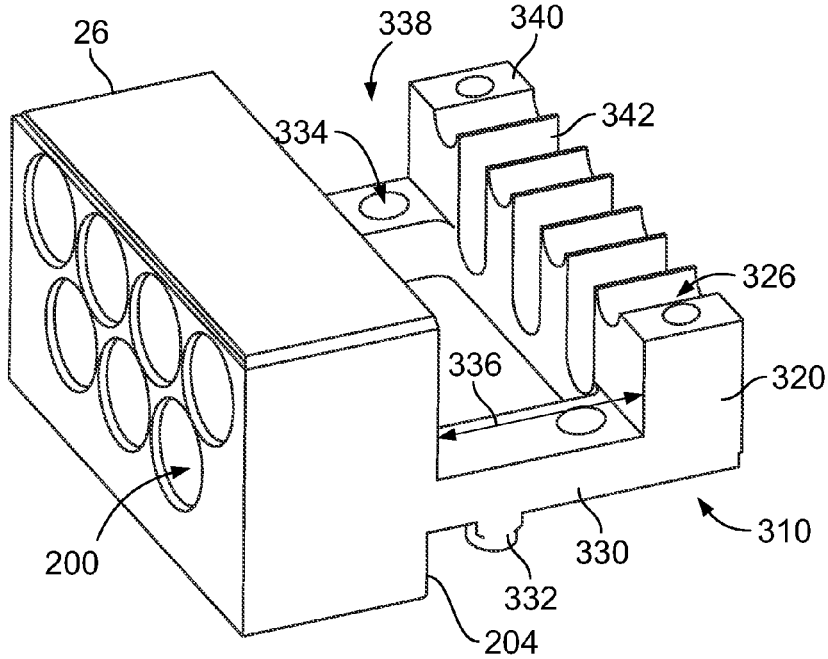
FIG. 7 is a front perspective view of a portion of the RF module shown in FIG. 6.

FIG. 7 is a front perspective view of the housing 26 and the strain relief feature 310. The connector cavities 200 extend through the housing 26. The strain relief feature 310 extends from the housing 26. In an exemplary embodiment, the strain relief feature 310 includes a pair of arms 330 that extend rearward from the rear wall 204. The base 320 is provided at the distal ends of the arms 330. The arms 330 include locating pins 332 extending downward therefrom. The locating pins 332 are configured to be received in corresponding openings in the daughtercard 17 (shown in FIG. 1). Optionally, the locating pins 332 may include crush ribs for securing the strain relief feature 310 to the daughtercard 17. The arms 330 include openings 334 that receive the fasteners 328, which secure the strain relief feature 310 to the daughtercard 17.

The connector cavities 200 are arranged in an upper row and a lower row. Any number of connector cavities 200 may be provided. In the illustrated embodiment, seven connector cavities 200 are provided with four connector cavities 200 in the upper row and three connector cavities 200 in the lower row. The connector cavities 200 are staggered to allow tighter spacing between the connector cavities 200.

The base 320 is spaced apart from the rear wall 204 by a distance 336. A space 338 is defined between the base 320 and the rear wall 204. The coaxial cables 32 (shown in FIG. 6) extend through the space 338. The strain relief feature 310 holds the coaxial cables 32 in a straight orientation through the space 338. The base 320 includes the pockets 326 arranged in a pattern that compliments the pattern of connector cavities 200. In an exemplary embodiment, the pockets 326 are arranged in an upper row and in a lower row. The number of pockets 326 corresponds with the number of connector cavities 200 and RF connectors 30 that are held in the connector cavities 200. The pockets 326 are generally aligned with corresponding connector cavities 200. In the illustrated embodiment, four pockets 326 are provided in the upper row and three pockets 326 are arranged in the lower row.

In an exemplary embodiment, the pockets 326 have a curved bottom. The pockets 326 have a radius of curvature that is substantially equal to a radius of curvature of the coaxial cables 32 that are to be received in the pockets 326. Each of the pockets 326 is open at a top 340 of the base 320. The pockets 326 in the lower row have generally vertical side walls 342 that extend from the top 340 down to the curved bottom. The coaxial cables 32 are loaded into the pockets 326 from above. The pockets 326 in the lower row extend to a greater depth from the top 340 than the pockets 326 in the upper row.

Figure 8:
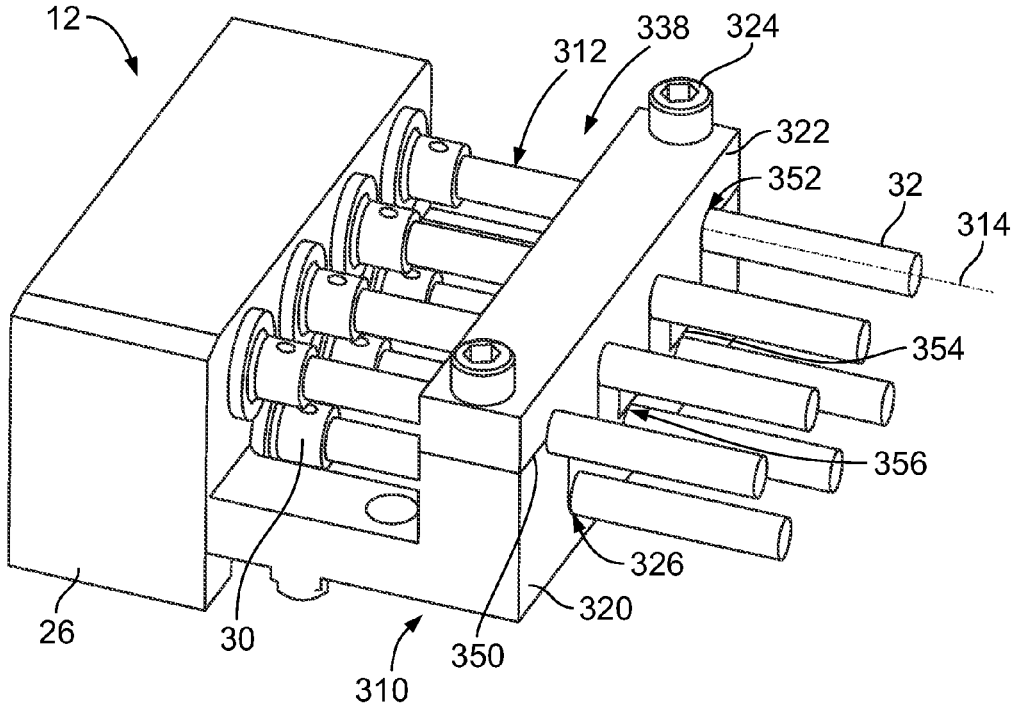
FIG. 8 is a rear perspective view of a portion of the RF module shown in FIG. 6.

FIG. 8 is a rear perspective view of a portion of the RF module 12 showing the housing 26 with the RF connectors 30 loaded into the housing 26 and the coaxial cables 32 extending from the RF connectors 30 through the strain relief feature 310. The cap 322 is coupled to the base 320. The cap 322 and the base 320 cooperate to capture the coaxial cables 32 and prevent lateral movement (e.g., side-to-side movement, up and down movement, and the like) of the portions of the coaxial cables 32 that extend through the strain relief feature 310. The end portions 312 of the coaxial cables 32 are held along the longitudinal axis 314. Even if the portions of the coaxial cables 32, rearward of the strain relief feature 310, are pulled in a lateral direction, the end portions 312 within the space 338 remained aligned with the RF connectors 30 along the longitudinal axis 314.

The cap 322 includes a bottom 350. Channels 352 are formed in the bottom 350 and are aligned with the pockets 326 in the upper row. The channels 352 receive the coaxial cables 32 in the upper row. The channels 352 have a radius of curvature that corresponds with the radius of curvature of the coaxial cables 32. When the cap 322 is coupled to the base 320, the channels 352 are aligned with the pockets 326 in the upper row to form a cylindrical opening that receives the corresponding coaxial cables 32.

The cap 322 includes a plurality of extensions 354 that extend from the bottom 350. The extensions 354 are received in the pockets 326 in the lower row. The extensions 354 extend downward from the bottom 350 along the vertical sides of the pockets 326 in the lower row. The bottoms of the extensions 354 include channels 356 that receive the coaxial cables 32 in the lower row.

In an exemplary embodiment, the cap 322 is secured to the base 320 using the fasteners 324. As the fasteners 324 are tightened, the coaxial cables 32 may be clamped between the base 320 and the cap 322. The coaxial cables 32 may be at least partially compressed such that the coaxial cables 32 are held within the pockets 326 and the channels 352, 356 by an interference fit. Optionally, the coaxial cables 32 are movable longitudinally along the longitudinal axis within the pockets 326 between the base 320 and the cap 322. The strain relief feature 310 holds the coaxial cables 32 in line with the RF connectors 30 to resist unwanted tilting or rotation of the RF connectors 30 with respect to the housing 26.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An RF module comprising:

a housing having walls defining connector cavities, the walls comprising a rear wall having a plurality of openings therethrough, the connector cavities being open opposite the rear wall to receive electrical connectors;

RF connectors received in the connector cavities, the RF connectors being terminated to corresponding cables, the RF connectors extending through corresponding openings, the RF connectors being spring loaded in the connector cavity to allow the RF connectors to float in the connector cavity; and a strain relief feature extending from the housing rearward of the rear wall, the strain relief feature having a plurality of pockets configured to receive corresponding cables extending from the RF connectors.

2. The RF module of claim 1, wherein the pockets are aligned with corresponding openings.

3. The RF module of claim 1, wherein the openings are arranged in a plurality of rows, the pockets being open at a top of the strain relief feature, the pockets being arranged in a plurality of rows at different depths from the top of the strain relief feature.

4. The RF module of claim 1, wherein the strain relief feature is integrally formed with the housing.

5. The RF module of claim 1, wherein the strain relief feature includes arms extending rearward from the rear wall, the strain relief feature including a base at distal ends of the arms, the pockets being formed in the base.

6. The RF module of claim 1, wherein the strain relief feature includes a base spaced apart from the rear wall, the pocket being formed in the base and being open at a top of the base, the strain relief feature having a cap separately provided from, and coupled to, the top of the base, the cap and the base cooperating to capture the cables therebetween.

7. The RF module of claim 1, wherein the pockets are aligned behind the openings along a longitudinal axis, the strain relief feature holding the cables along the longitudinal axis such that the RF connectors are oriented along the longitudinal axis.

8. The RF module of claim 1, wherein each RF connector includes a shell and a center contact held within the shell, the RF connector having a mating end and a cable end opposite the mating end, the cable end terminated to the cable, the shell having a flange proximate to the cable end, the flange being positioned rearward of the rear wall, the RF connector having a spring circumferentially surrounding the shell, the spring engaging the rear wall interior of the connector cavity.

9. An RF module comprising:

a housing having walls defining connector cavities, the walls comprising a rear wall having a plurality of openings therethrough, the openings being configured to receive corresponding RF connectors therein with portions of the RF connectors received in corresponding connector cavities and portions of the RF connectors positioned rearward of the real wall, RF connectors being spring loaded, the connector cavities being open opposite the rear wall to receive electrical connectors configured to mate with the RF connectors held by the housing; and a strain relief feature extending from the housing rearward of the rear wall, the strain relief feature having a plurality of pockets configured to receive cables extending from corresponding RF connectors.

10. The RF module of claim 9, wherein the pockets are aligned with corresponding openings.

11. The RF module of claim 9, wherein the openings are arranged in a plurality of rows, the pockets being open at a top of the strain relief feature, the pockets being arranged in a plurality of rows at different depths from the top of the strain relief feature.

12. The RF module of claim 9, wherein the strain relief feature is integrally formed with the housing.

13. The RF module of claim 9, wherein the strain relief feature includes arms extending rearward from the rear wall, the strain relief feature including a base at distal ends of the arms, the pockets being formed in the base.

14. The RF module of claim 9, wherein the strain relief feature includes a base spaced apart from the rear wall, the pocket being formed in the base and being open at a top of the base, the strain relief feature having a cap separately provided from, and coupled to, the top of the base, the cap and the base cooperating to capture the cables therebetween.

15. An electrical connector system comprising:

an RF module comprising:

a housing having walls defining connector cavities, the walls comprising a rear wall having a plurality of openings therethrough, the connector cavities being open opposite the rear wall to receive electrical connectors;

RF connectors received in the connector cavities, the RF connectors being terminated to corresponding cables, the RF connectors extending through corresponding openings, the RF connectors being spring loaded in the connector cavity to allow the RF connectors to float in the connector cavity; and a strain relief feature extending from the housing rearward of the rear wall, the strain relief feature having a plurality of pockets configured to receive corresponding cables extending from the RF connectors; and an electrical connector assembly having a housing holding a plurality of electrical connectors, each electrical connector having a shell holding a center contact, the electrical connector assembly being coupled to the RF module such that the electrical connectors are mated with corresponding RF connectors.

16. The electrical connector system of claim 15, wherein the pockets are aligned with corresponding openings.

17. The electrical connector system of claim 15, wherein the openings are arranged in a plurality of rows, the pockets being open at a top of the strain relief feature, the pockets being arranged in a plurality of rows at different depths from the top of the strain relief feature.

18. The electrical connector system of claim 15, wherein the strain relief feature is integrally formed with the housing.

19. The electrical connector system of claim 15, wherein the strain relief feature includes arms extending rearward from the rear wall, the strain relief feature including a base at distal ends of the arms, the pockets being formed in the base.

20. The electrical connector system of claim 15, wherein the strain relief feature includes a base spaced apart from the rear wall, the pocket being formed in the base and being open at a top of the base, the strain relief feature having a cap separately provided from, and coupled to, the top of the base, the cap and the base cooperating to capture the cables therebetween.

* * * * *